United States Patent [19]

Büchler et al.

[11] 4,103,861

[45] Aug. 1, 1978

[54] ARRANGEMENT FOR THE SECTIONAL CANTILEVER PROJECTION OF MULTI-PANEL BRIDGE SUPPORTING STRUCTURES OF STEEL OR PRESTRESSED CONCRETE

[75] Inventors: Wilhelm Büchler, Munich; Gotthard Müller, Aschheim; Hans-Joachim Mende, Munich, all of Fed. Germany

[73] Assignee: Dyckerhoff & Widmann Aktiengesellschaft, Munich, Germany

[21] Appl. No.: 769,729

[22] Filed: Feb. 17, 1977

[30] Foreign Application Priority Data

Feb. 26, 1976 [DE] Fed. Rep. of Germany ..... 2607805

[51] Int. Cl.[2] ..... E01D 1/00

[52] U.S. Cl. ..... 249/20; 425/63; 14/1; 182/36; 182/150

[58] Field of Search ..... 14/1; 249/20; 425/62, 425/63; 182/150, 36

[56] References Cited

U.S. PATENT DOCUMENTS

| | | | |
|---|---|---|---|
| 3,076,522 | 2/1963 | Goodell | 182/36 X |
| 3,145,801 | 8/1964 | Callahan | 182/63 |
| 3,456,756 | 7/1969 | Price | 182/63 |
| 3,550,723 | 12/1970 | Gentry | 182/36 |
| 3,608,669 | 9/1971 | Lindsay | 182/63 |
| 3,985,480 | 10/1976 | Finsterwalder | 249/20 X |
| 3,989,218 | 11/1976 | Muller | 249/20 |

FOREIGN PATENT DOCUMENTS

| | | | |
|---|---|---|---|
| 1,236,546 | 3/1967 | Fed. Rep. of Germany | 14/1 |
| 2,205,250 | 8/1973 | Fed. Rep. of Germany | 14/1 |
| 2,240,678 | 3/1974 | Fed. Rep. of Germany | 14/1 |
| 2,365,076 | 7/1975 | Fed. Rep. of Germany | 14/1 |
| 1,092,355 | 11/1967 | United Kingdom | 14/1 |

*Primary Examiner*—Nile C. Byers

*Attorney, Agent, or Firm*—Toren, McGeady and Stanger

[57] ABSTRACT

This invention relates to an arrangement for projecting cantilever sections of multi-sectional bridge supporting structures of steel or prestressed concrete forming the superstructure of the bridge which is supported on bridge piles. The arrangement includes at least one traveling auxiliary beam movably carried on and arranged above the superstructure for spanning between superstructure sections. Two concreting scaffolds each comprising a supporting part having crossbeams and rollers are arranged above the superstructure and carry a platform which is arranged below the superstructure for carrying casings to extend the projecting superstructure sections. A transport device is movably carried on the auxiliary beam and supports the concreting scaffolds for transport between superstructure sections and from the end of a completed section to a bridge pile for beginning construction of a new section. The supporting part of each of the concreting scaffolds has longitudinal girders arranged adjacent the auxiliary beam and crossbars connected to the girders arranged below the auxiliary beam. A pair of supporting blocks for supporting the auxiliary beam on the next succeeding pile are arranged so as to be alternately retractable to allow the supporting part of the scaffolds to pass the bridge pile, and the platform of the scaffolds comprises a bending resistant lattice of crossbeams and girders with means for forming openings therein to allow the platform to pass the pile as the scaffold is transported to the next section.

11 Claims, 27 Drawing Figures a b c d e f g h i k

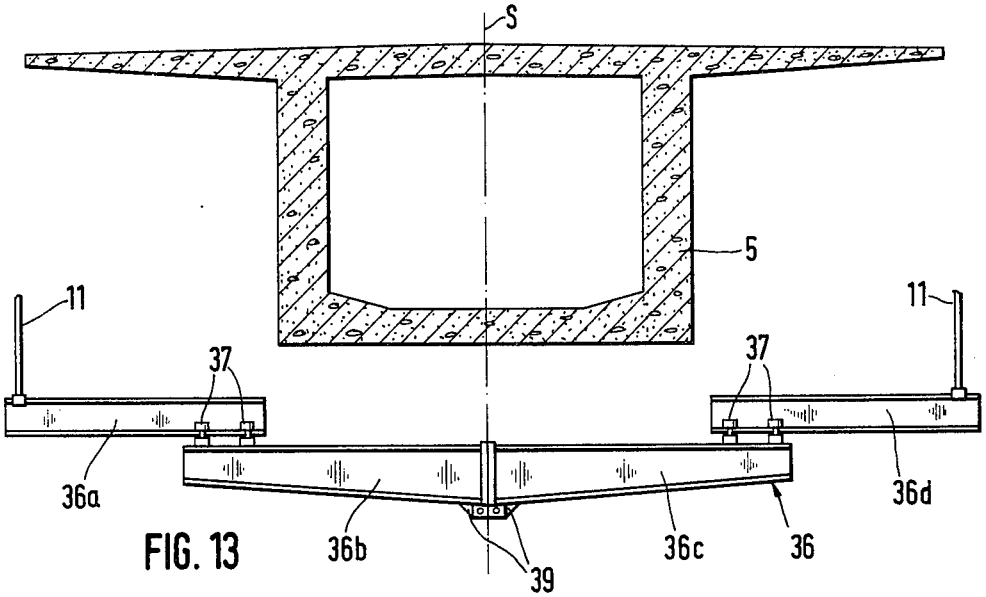
FIG. 13
FIG. 14
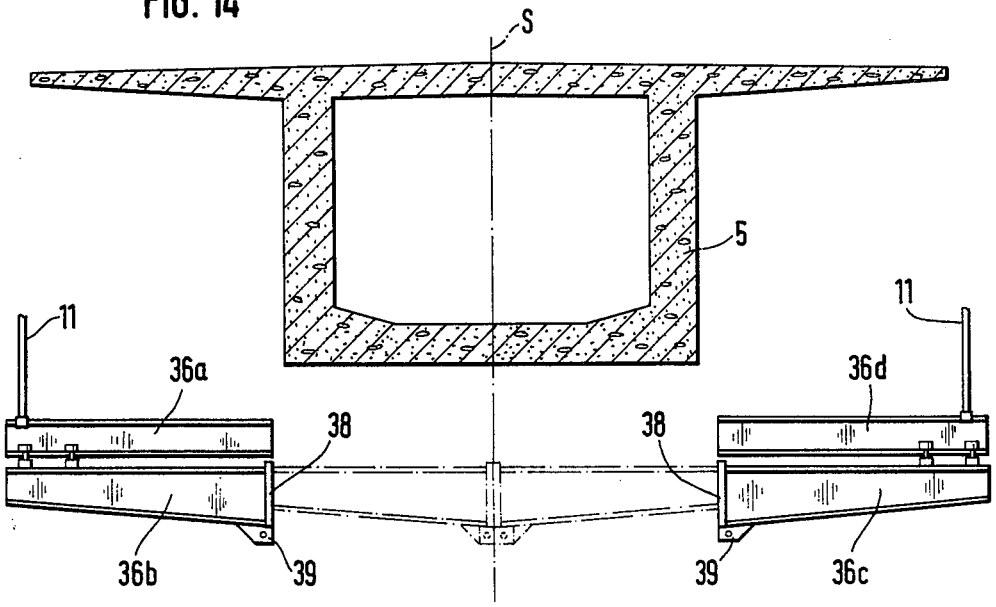

ARRANGEMENT FOR THE SECTIONAL CANTILEVER PROJECTION OF MULTI-PANEL BRIDGE SUPPORTING STRUCTURES OF STEEL OR PRESTRESSED CONCRETE

BACKGROUND OF THE INVENTION

The invention relates to an arrangement for the projection of cantilever sections of multi-section bridge supporting structures of steel or prestressed concrete forming a superstructure, and particularly to such an arrangement having two concreting scaffolds each composed of a supporting part with crossbeams arranged above the superstructure of the bridge and provided with traveling gears or rollers. A platform is suspended from the supporting part and arranged below the superstructure carrying casings for extending the superstructure sections. A traveling auxiliary beam spans at least one of the superstructure sections and is arranged above the superstructure being supported on retractable supporting blocks.

In the production of superstructures for bridges using sectional cantilever projections, so-called "projection cars" which are carried on the section of the existing superstructure and project beyond this bridge or superstructure section, are known. The projection cars carry a casing, for the next section to be connected, on a platform arranged underneath the superstructure (see German Pat. No. 973,407). These projection cars are particularly suitable for the production of double cantilevers projecting from a support which can then be assembled to the bridge supporting structure by joining the cantilever ends.

A disadvantage of these projection cars is that of the two projection cars required for the production of a double cantilever, one must always work in the direction in which the bridge sections are being extended, while the other works in the opposite direction. The special design of these projection cars, having a platform arranged underneath the superstructure, which carries the casing, has the effect that the space below the bridge is blocked by this platform so that these cars can not pass by the bridge piles of multi-section bridges. In order to transport the projection cars after the completion of one of the superstructure sections, they must be disassembled, transported on land to the next support or pile and be assembled there again.

Furthermore, since the projection cars are carried on the finished bridge section and project for the construction of the next section, they are only supported by a pile when the section of the superstructure directly above the pile is already concreted in the respective direction of projection. But these operations require a separate casing which must be either arranged on the pile or which rests on the terrain.

In a known arrangement of the above described type it is known to use traveling concreting scaffolds which are suspended on a scaffold carrier arranged above the superstructure, (see German Pat. No. 1,225,695). In these concreting scaffolds, which have a platform suspended over hangers, arranged underneath the superstructure of the bridge and carry the casing, the loads are transposed from the concreting scaffold, and the respective bridge section to be built, to the bridge pile. The scaffold carrier must therefore be very heavy. This disadvantage can not be completely eliminated even if the auxiliarly beam, as it is also sometimes referred to, bears progressively next to the section to be produced on the finished superstructure section (see German Pat. No. 1,263,806).

It is an object of the invention to overcome the foregoing problems and to be able to use concreting scaffolds which can travel on the superstructure and project above a completed cantilever end, and to be able to transfer these concreting scaffolds with an auxiliary beam arranged above the superstructure to the next pile.

SUMMARY OF THE INVENTION

This object is accomplished, and the problem is solved, according to the invention by providing that the concreting scaffolds can be transported from the end of a cantilevered superstructure section which has been completed to the bridge supporting pile to begin work on the next section by providing an auxiliary beam movably carried on and arranged above the superstructure for spanning between the completed superstructure sections and the next succeeding supporting pile, and a transport device arranged on the auxiliary beam for supporting the concreting scaffold. The concreting scaffold carries a supporting part formed by longitudinal girders and crossbeams secured to the girders and arranged underneath the auxiliary beam. The scaffold carries a platform having girders and crossbeams with means for forming openings therein corresponding to the width of a bridge pile to allow the platform to pass the pile. The auxiliary beam is supported by two supporting blocks relative to the next pile which are alternately retractable to allow the cross beams of the supporting part of the scaffold to pass the piles.

The advantage of the invention lies in the fact that a uniform apparatus is provided having the foregoing arrangement according to the invention including two projection cars running at the top of the auxiliary beam in which the individual parts for the production of the total bridge superstructure are optimally adapted to each other. The use of projection cars running at the top of the beam provides favorable conditions with respect to the introduction of forces. In particular it is possible to build wide bridges in one operation. The auxiliary beam permits simple and safe transport of the projection cars to the next pile and can serve as a transport bridge for construction material during the progress of the work. Due to the special design of the supporting parts of the respective projection cars arranged above the superstructure and of the supporting blocks for supporting the auxiliary beam, it is possible to move the construction parts without substantial interference.

The longitudinal girders of one of the two concreting scaffolds has a forked arrangement in the rear part of the girders so that an extension of the girders on the other scaffold may be inserted into the forked spread. In this manner it is possible to use two projection cars and locate them at the head of one pile with a minimum distance between them so that they can be positioned together.

Since the auxiliary beam, which serves primarily to transport the concreting scaffolds to the next pile, is only used for transporting material during the progress of the construction, and is not fully utilized in its supporting capacity, it is possible to rigidly connect it during the production of the superstructure cantilever both to the cantilevered section and to a finished bridge section in order to stabilize the cantilever. Auxiliary supports, such as are provided only for the construction can thus be eliminated.

BRIEF DESCRIPTION OF THE DRAWINGS

Other features and advantages of the invention will appear from the following description of the embodiments of the invention illustrated in the drawings, in which

FIGS. 13 and 14 are cross sections schematically showing another embodiment of the platform;

DESCRIPTION OF THE INVENTION

Figures 1A, 1B, 1C, 1D, 1E, 1F, 1G, 1H:
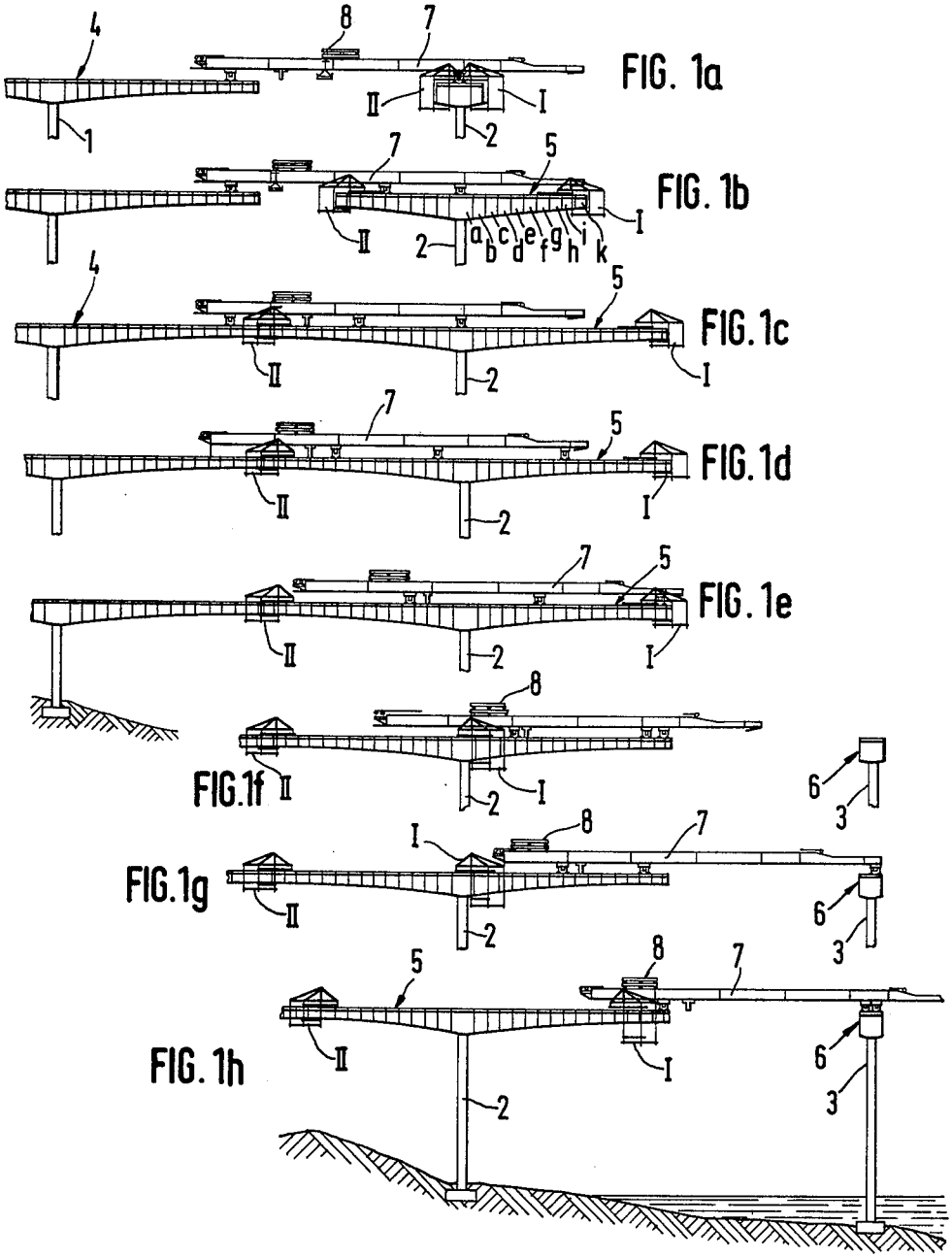
FIGS. 1*a* to *h* are side elevational views showing a number of characteristic phases of construction of a bridge supporting structure by using the arrangement according to the invention.

Referring now in more detail to the drawings, FIG. 1*a* to *h* show eight characteristic phases of construction in the production of a multi-section bridge supporting structure. FIG. 1*h* shows the general location of the bridge with respect to the terrain, while FIGS. 1*a* to 1*g* only show the superstructure.

Figure 16:
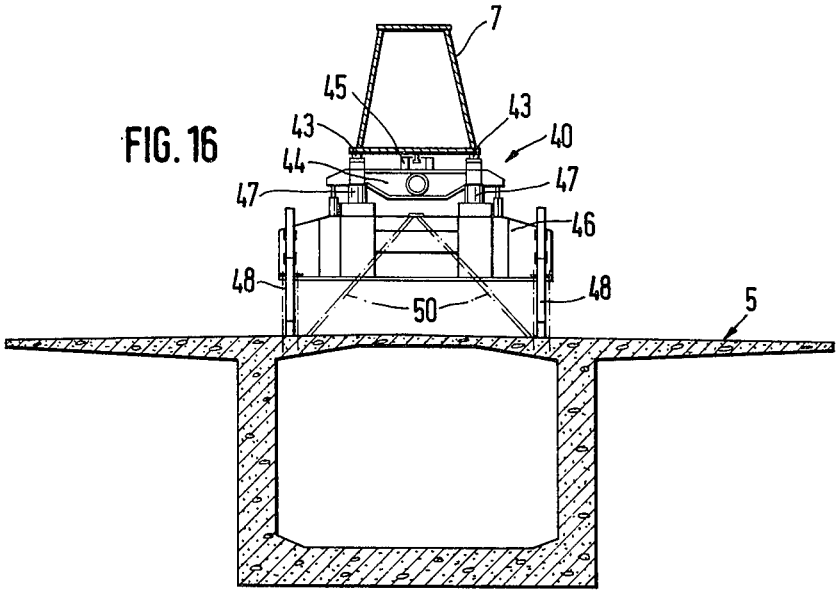
Figure 17:
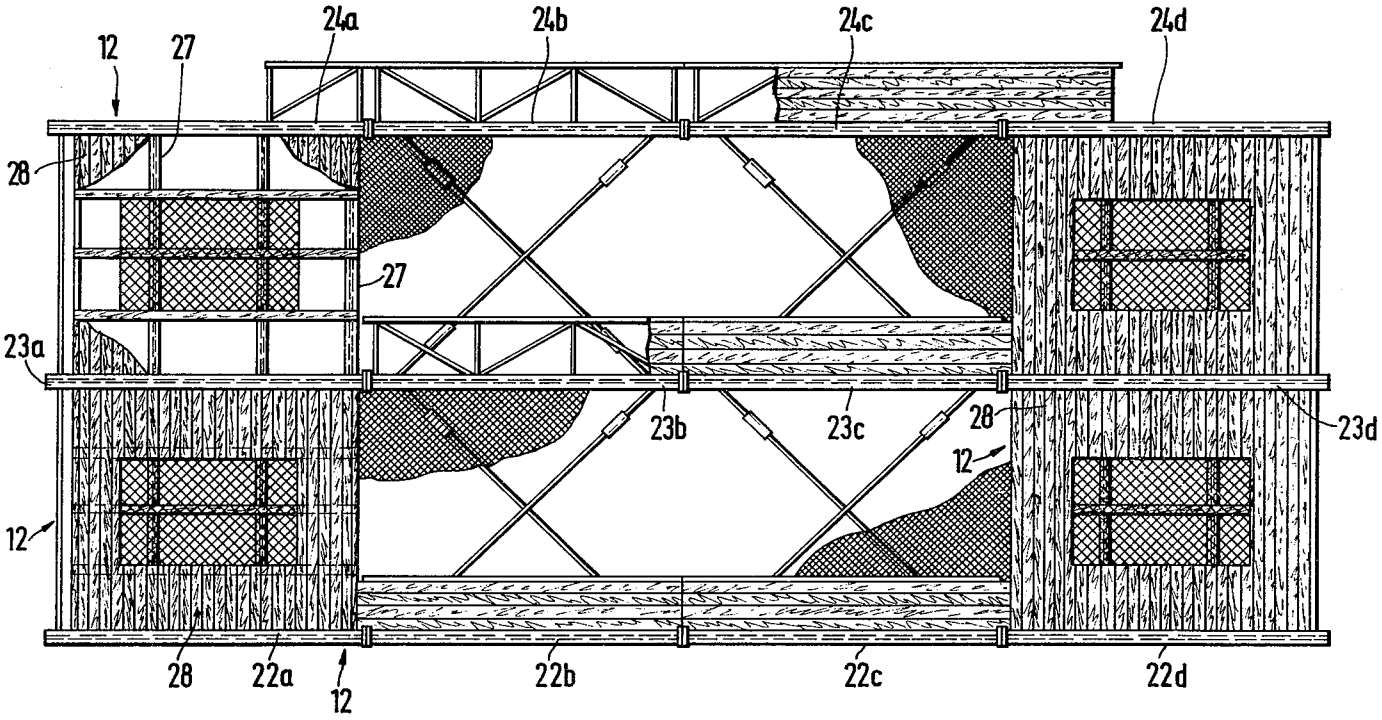
FIG. 17 is a top view in the direction of lines XVII—XVII of FIGS. 2 and 3 showing the platform of a concreting scaffold.

In the phase of construction shown in FIG. 1*a*, the piles 1 and 2 have been installed. The superstructure section 4 resting on the pile 1 has been completed in the form of a double cantilever produced successively from individual sections. Two concreting scaffolds I and II, so-called "projection cars", are arranged on the head of pile 2 in a position relative to each other so that the superstructure part 5, associated with pile 2, can be started. An auxiliary beam of steel 7 extends from the top of the cantilevered end of superstructure part 4 to the section of the superstructure part 6 directly on top of pile 2, which was produced in a conventional manner. In the embodiment shown herein, the beam of steel 7 has a closed box cross section as shown in FIG. 16. A transport device 8, which serves to transport the projection cars I and II from the finished superstructure section to the next pile is arranged on the auxiliary beam 7.

In the phase of construction shown in FIG. 1*b*, the superstructure section 5, which was under construction in FIG. 1*a*, has grown considerably. FIG. 1*c* shows the phase in which the space between the superstructure sections 4 and 5 is closed by projection car II; the double cantilever of superstructure section 5 is thus completed. FIG. 1*d* illustrates the transfer of auxiliary beam 7 to the next pile 3 being prepared by displacing supporting blocks, which are described more fully hereinafter.

In FIG. 1*e*, auxiliary beam 7 is shown as having been advanced onto the top of superstructure part 5. Projection car I is lifted by transport device 8 and is moved in the next phase to pile 3 to be installed there, as shown in FIG. 1*a* with regard to pile 2. This installation will be further explained in connection with FIGS. 5 to 10. Then projection car II is moved to superstructure section 5 until it can be received by transport device 8 and is brought to pile 3 in a position which corresponds to that shown in FIG. 1*a*.

Figure 2:
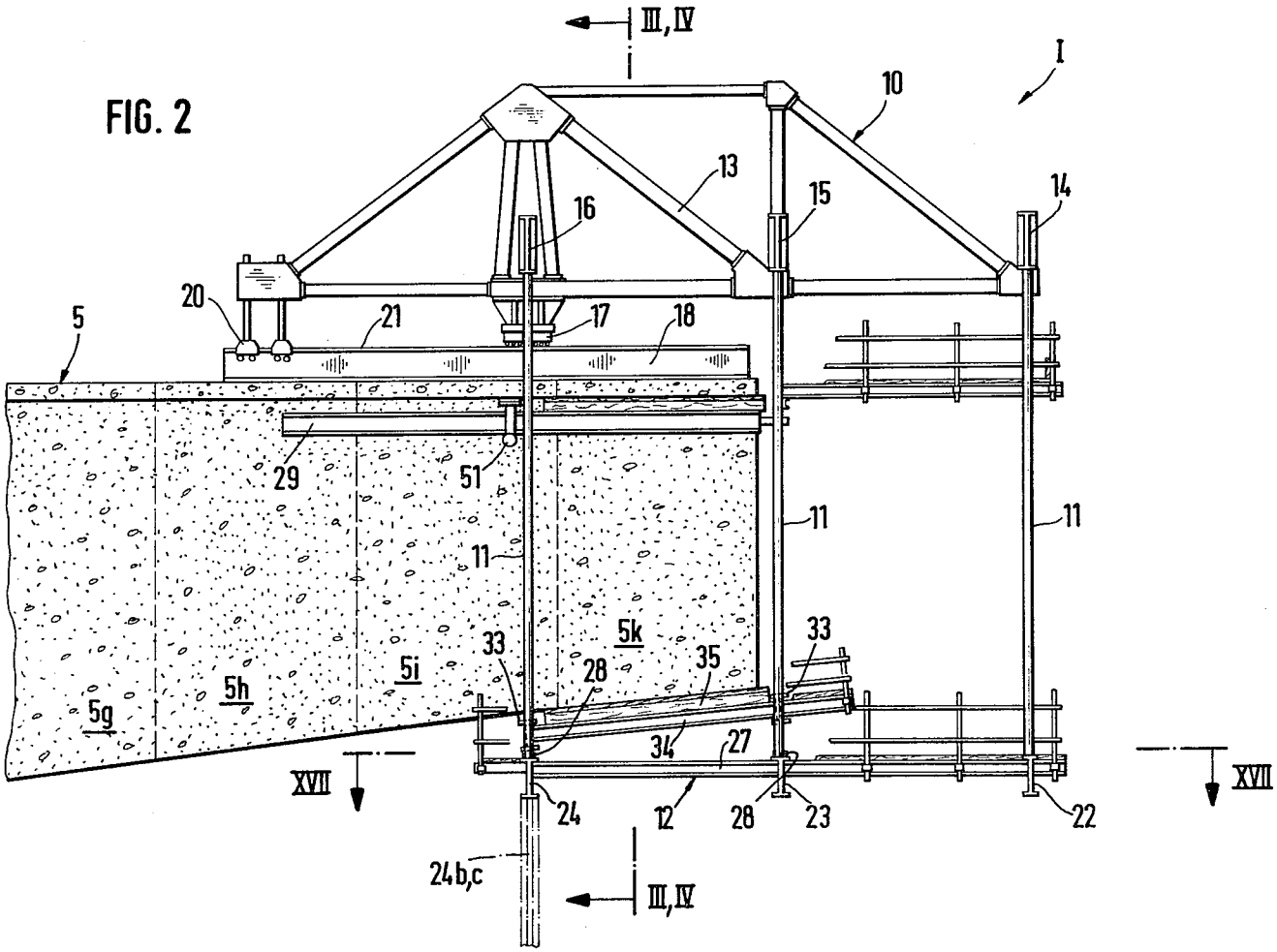
FIG. 2 is a side elevational view showing a concreting scaffold.

In FIG. 2 the projection car I is represented on an enlarged scale in the position shown in FIG. 1*b* during the production of the superstructure section 5. Projection car I substantially comprises a supporting part 10 arranged above superstructure section 5 and a platform 12 suspended thereon by hangers 11.

The supporting part 10 has two longitudinal girders 13, which are designed as truss disks and are joined by three crossbeams 14, 15 and 16.

Rollers 17 are provided on longitudinal girders 13 and ride on rails 18. Hydraulic presses are arranged in the area of the rollers to relieve the rollers in the concreting stage or to effect any vertical adjustments. The longitudinal girders 13 are provided, at their rear end, with rollers 20, which extend under the bottom flange 21 of rail 18 and prevent the projection car I from tipping. Relief of the rollers 20 during the concreting is accomplished by rear bracing of the supporting part relative to superstructure section 5.

Figure 3:
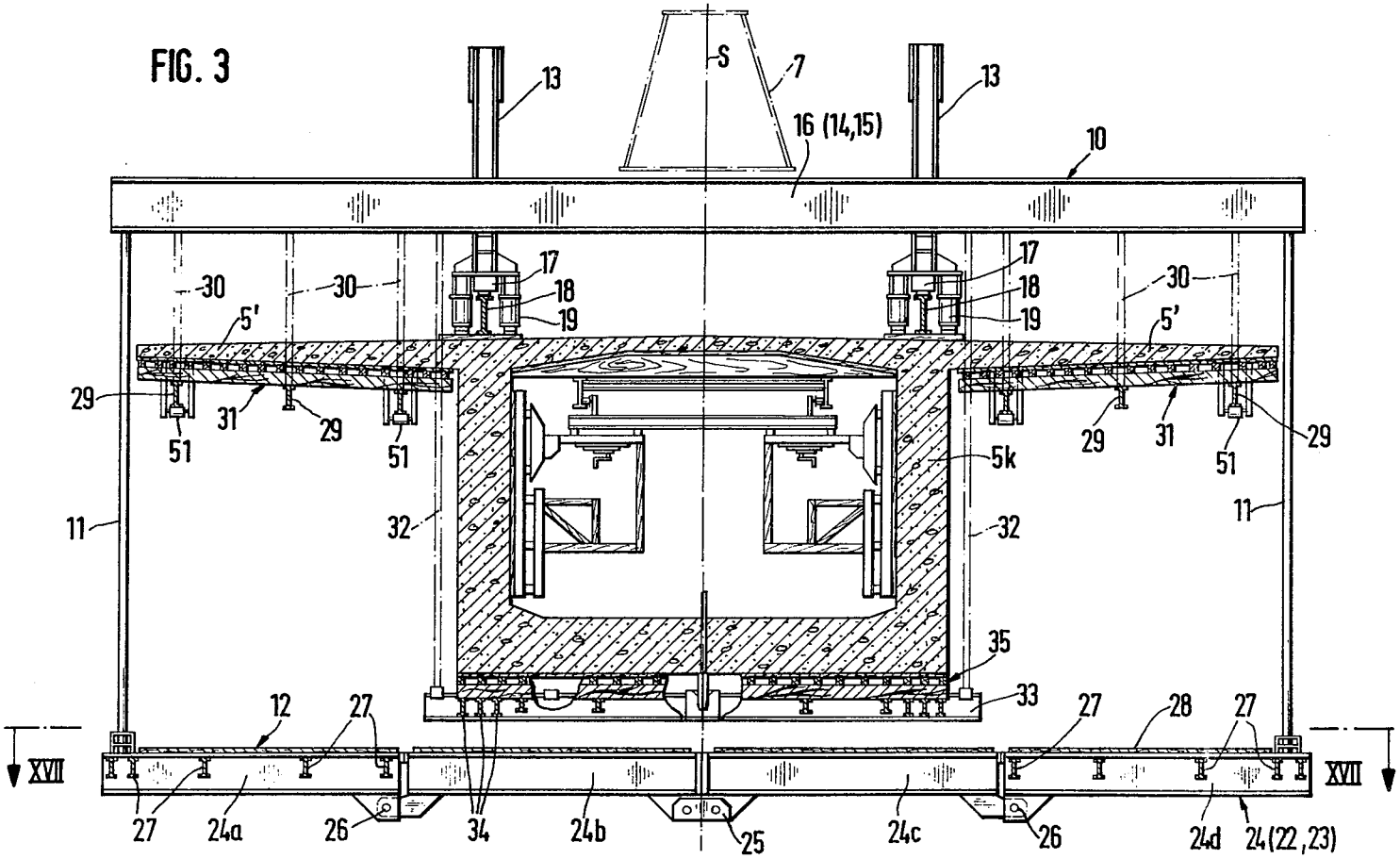
FIG. 3 is a cross sectional view taken along lines III—III of FIG. 2 showing a concreting scaffold in the position during transport to the next pile.

Platform 12 includes three crossbeams 22, 23, 24, corresponding to the crossbeams 14, 15, 16 of supporting part 10, and each of the crossbeams 22, 23, 24 has four parts (e.g. 24*a*, 24*b*, 24*c*, 24*d*, as seen in FIG. 3), which are designed and arranged symmetrically with respect to the longitudinal center axis S of the bridge. The outer parts 24*a* and 24*d* of crossbeam 24 are connected with the hangers 11 and remain in this position. The two inner parts 24*b* and 24*c*, are connected together by butt strap 25 when in use, but can be swung out about hinges 25 when passing a pile, by disengaging butt joint 25, see FIG. 4. The outer parts 24*a* and 24*d* of the platform crossbeam 24, as well as the corresponding parts of the other crossbeams 22 and 23, are connected by longitudinal girders 27. The crossbeams 22, 23 and 24 are provided with a plank 28 on their top flanges.

Casing parts 31 for the laterally projecting parts 5' of the superstructure are suspended from hangers 30 on the crossbeams 14, 15 and 16 of supporting part 10. They are arranged on longitudinal girders 29, which extend over roller blocks 51. Also suspended directly on the crossbeams 14, 15 and 16 on hangers 32, are bottom casing crossbeams 33 which are connected by longitudinal girders 34 on which the bottom casing 35 rests. Due to the suspension of bottom casing 35 from the supporting part, the bottom edge of the superstructure can be easily adapted to different construction heights of the superstructure, and particularly the center of platform 12 remains free so that it can be opened when it passes a pile.

Figure 4:
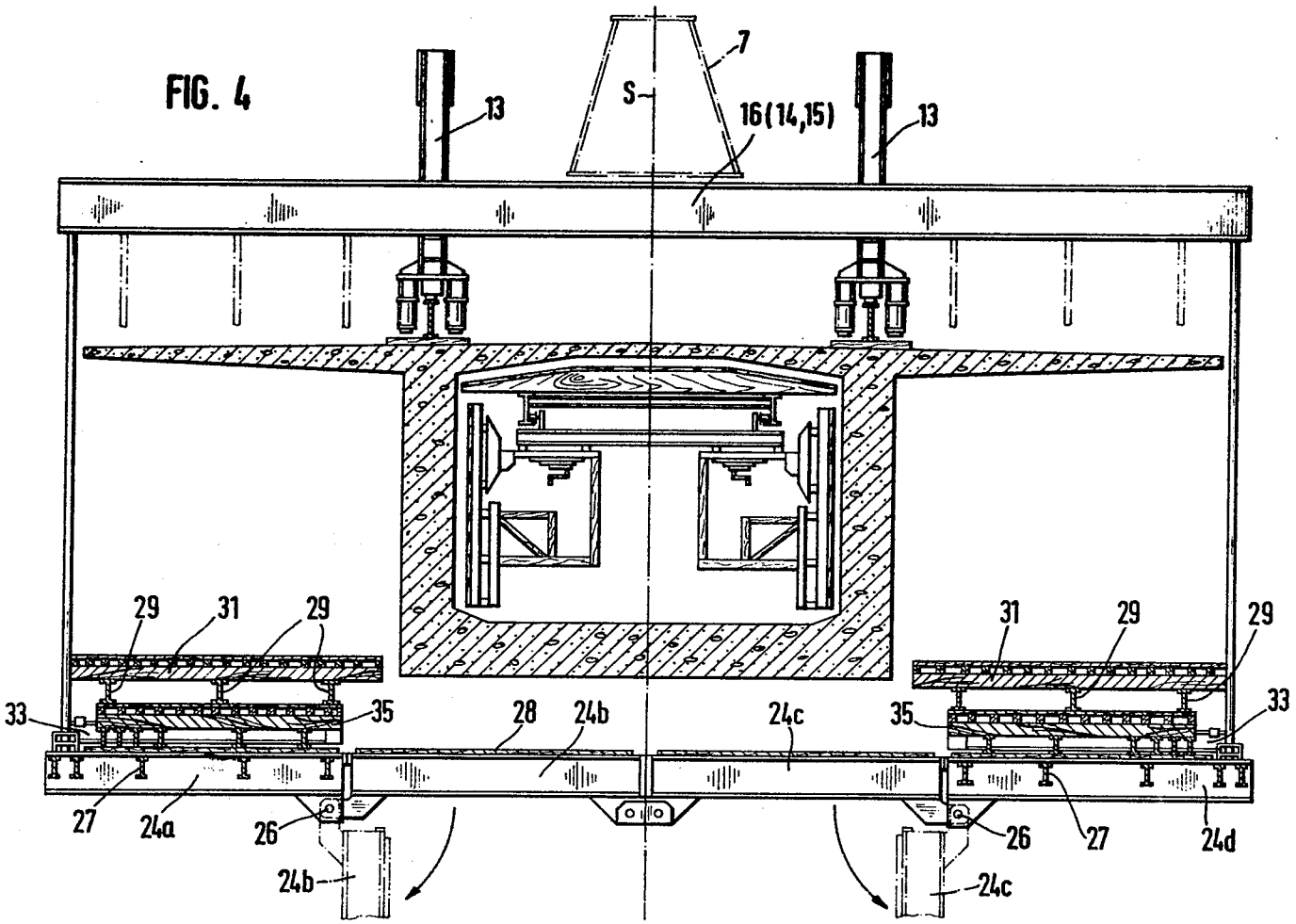
FIG. 4 is a cross sectional view taken along lines IV—IV of FIG. 2 and similar to that of FIG. 3 showing the concreting scaffold in a position for depositing casing parts on the platform.

The passing of a pile by projection car I, i.e., that phase of the construction that takes place between the construction phases represented in FIG. 1*h*, relative to pile 3, and the construction phase corresponding to that in FIG. 1*a* is of importance for repositioning platform 12 and supporting part 10. Transport device 8, which moves on auxiliary beam 7 by means of dollies 9, is used for transporting a projection car to the next pile. By means of transport device 8, both supporting part 10 and platform 12 can be moved and transported either jointly or separately. FIG. 4 shows the depositing of the casing parts on the platform in cross section, and FIGS. 5 to 10 show the transposition of the supporting part independent of the platform.

Supplementing the position of projection car I in concreting a bridge section shown in FIG. 3, FIG. 4 shows the position during the transporting of a projection car to the next pile. In this state, the entire bottom casing of the respective section consisting of bottom casing crossbeam 33, bottom casing longitudinal girder 34, and bottom casing 35 proper, are lowered onto the crossbeams 23 and 24 of the platform. After separating the bottom casing crossbeams 33 in the range of the axis of symmetry S, the two bottom casings can be displaced along plank 28 an the outside on the fixed parts 24*a* and 24*d* respectively of the platform crossbeams. Then the casing parts 31 are lowered. In this state the entire inner zone of platform 12 below the superstructure proper, which generally has the same width as a pile, is open. The rigidity of the girder grate formed by the platform crossbeams 22, 23 and 24, as well as the platform longitudinal girders 27 is so great that one of the platform crossbeams can be opened to pass by the girder. This is done by swinging out the central parts 24*b* and 24*c* of crossbeam 24 which is indicated in FIGS. 2 and 4 in broken lines.

While the formation of an opening in the platform is achieved in FIG. 4 by swinging out the inner parts of the platform crossbeams, these can also be displaced to the outside by moving them longitudinally in their plane. This possibility is indicated schematically in FIGS. 13 and 14. The platform crossbeam 36 shown here consists again of four parts 36*a*, 36*b*, 36*c*, 36*d* which are designed and arranged symmetrically to the longitudinal axis S of superstructure 5. While the hangers 11 act on the two outer ends of the two outer parts 36*a* and 36*d*, the parts 36*a* and 36*b* and 36*c* and 36*d* respectively are connected over rollers and movable with respect to each other. The parts 36*b* and 36*c* are detachably connected at the axis of symmetry S for compression and tension by means of pressure plates 38 and pull straps 39. After this connection is disengaged, the parts 36*b* and 36*c* can be displaced to the outside (FIG. 14), so that an opening for passing a pile is formed underneath the superstructure.

While transport device 8, which can travel on the top edge of auxiliary beam 7, transports a projection car or at least the supporting part 10 of a projection car for use on the next pile, the auxiliary beam 7 bears on this pile over two supporting blocks 41 and 42. Both supporting blocks 41 and 42 are provided with rollers 43 suspended from the bottom edge of auxiliary beam 7 with which they can be moved. The structural elements of each of the supporting blocks 41 and 42 can be seen in detail in FIGS. 15 and 16. The rollers between the supporting blocks and auxiliary beam 7 must be double action rollers to ensure the movement of the auxiliary beam relative to a fixed supporting block and also to allow movement of the supporting block relative to a fixed auxiliary beam 7.

Figure 15:
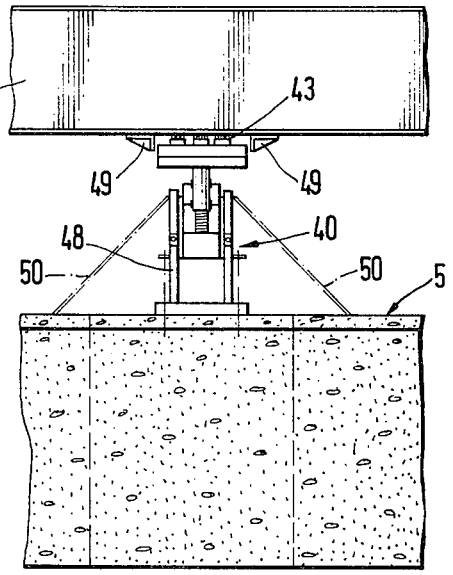
FIGS. 15 and 16 are a side elevation and a front view respectively showing a supporting block for fixing the auxiliary beam relative to the superstructure.

In the supporting block 40 represented in FIGS. 15 and 16, the auxiliary beam 7 is mounted on rollers 43 which are arranged on an upper traverse 44. Rollers 45 are also arranged on the upper traverse 44 and are used when the supporting block 40 on auxiliary beam 7 is to be transported while suspended. Upper traverse 44 is connected with a lower traverse 46 from hydraulic presses 47. Legs 48 arranged on lower traerse 46 can be displaced laterally to the outside, and serve to support supporting block 40 relative the bridge superstructure 5.

FIGS. 5 to 10 show the various steps of transporting projection car I from the position in FIG. 1*h* into the position shown in FIG. 1*a*.

Figure 5:
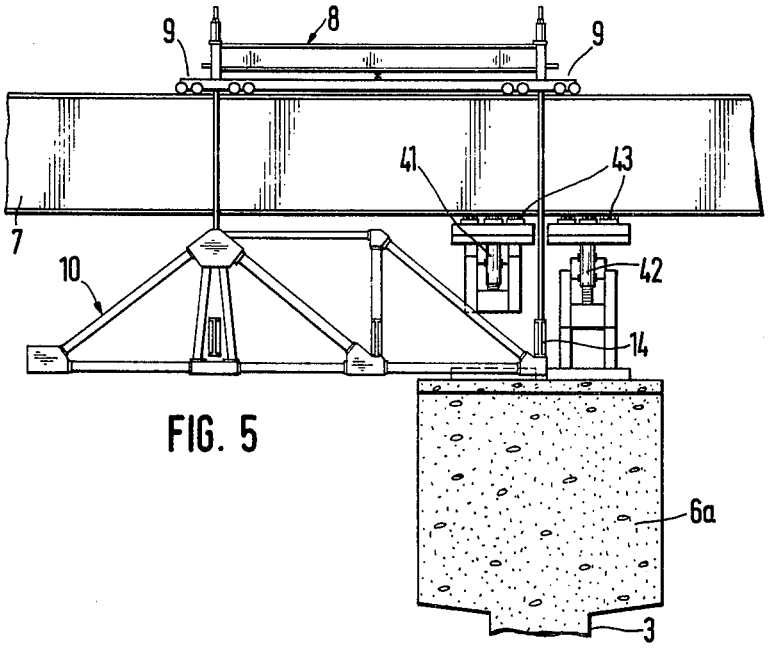
FIGS. 5 to 10 are schematic side views showing some of the working phases during the transport of the supporting part to the next pile.
Figure 6:
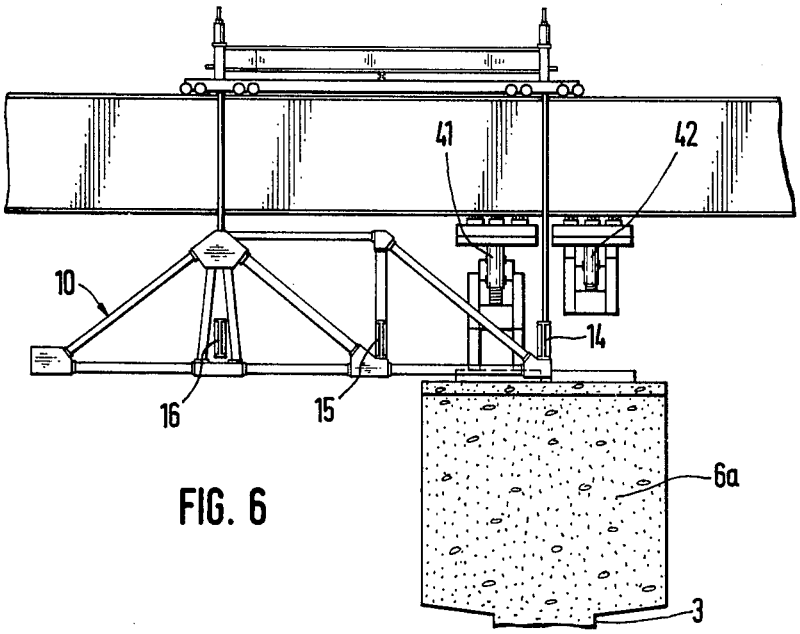
Figure 7:
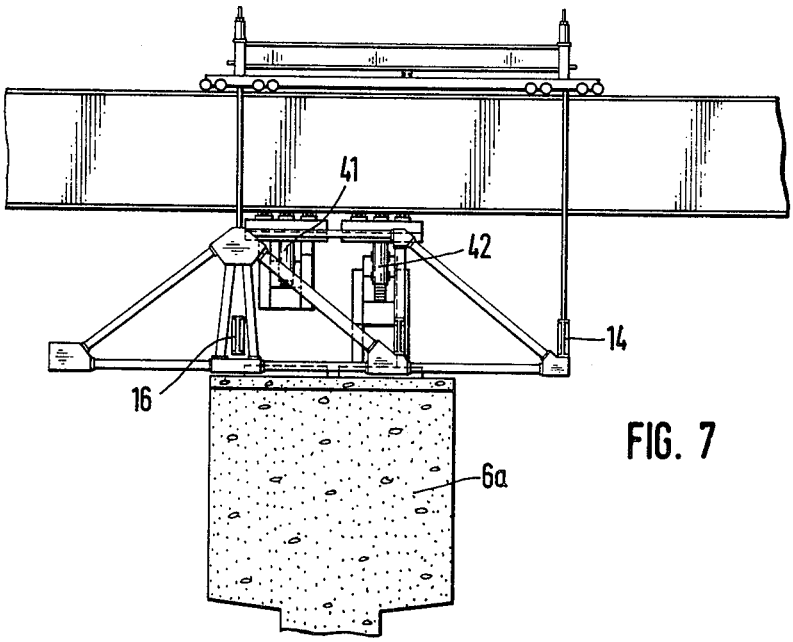
Figure 8:
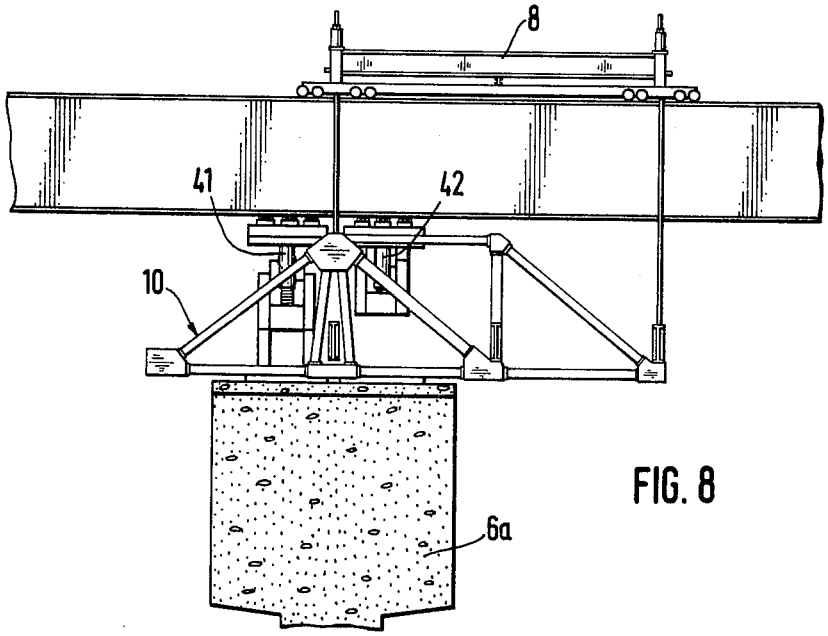
Figure 9:
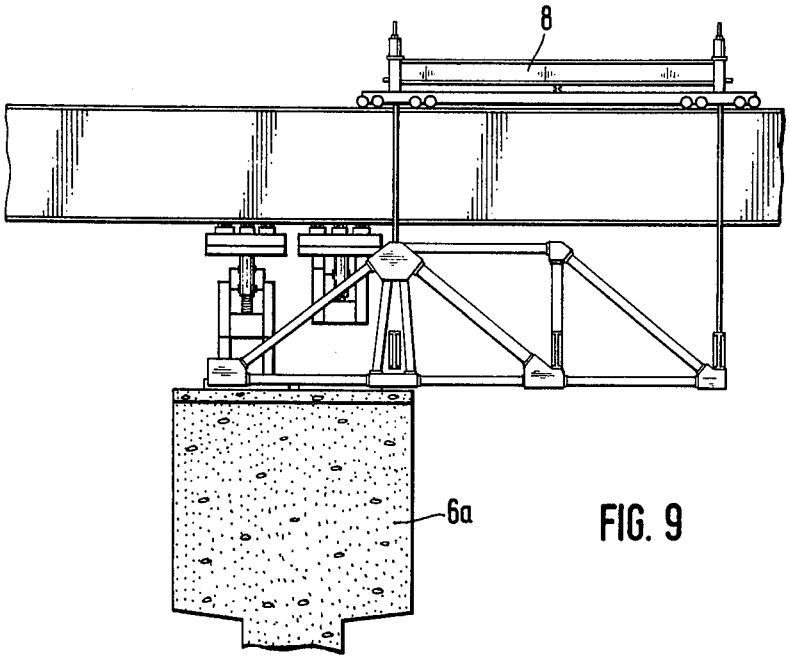
Figure 10:
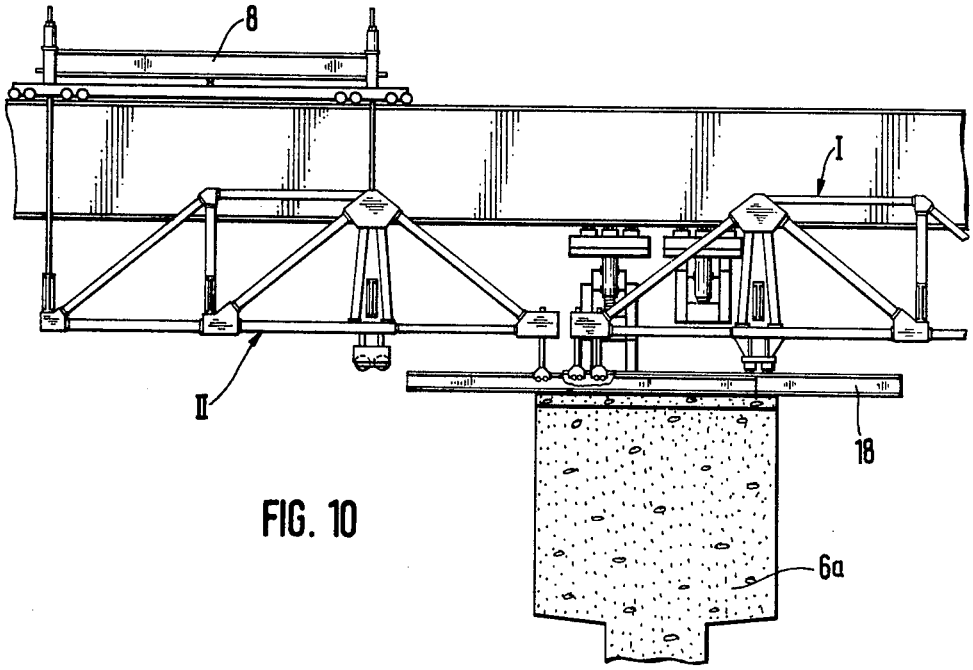

In the phase of construction shown in FIG. 5, the left supporting block 41 is pulled as far as possible upward by retracting the hydraulic presses 47 and the legs 48; it is suspended on auxiliary beam 7, which in turn bears on supporting block 42 on the superstructure section 6*a*. In this phase, supporting part 10, suspended on transport device 8 and somewhat lowered after removal of the rollers 17 and 20, can pass supporting block 41 with the front crossbeam 14. Then supporting block 41 is extended downward and supporting block 42 is retracted (FIG. 6). At the same time, the central crossbeam 15 is separated; it is not absolutely required to stabilize supporting part 10 in the unloaded condition. In this condition, supporting part 10 can be advanced into the position shown in FIG. 7, in which the rear crossbeam 16 is directly in front of supporting block 41. After lowering supporting block 42 and retracting supporting block 41, supporting part 10 can pass supporting block 41 (FIG. 8) and supporting block 41 can be extended again. After retracting supporting block 42, supporting part 10 can reach the end position (FIG. 9) and be deposited again on its rail 18, after lifting and again installing the rollers 17 and 20. By means of a trolley or transport device 8 the rear projection car II can be moved up and likewise be deposited on the superstructure part 6*a*.

Figure 11:
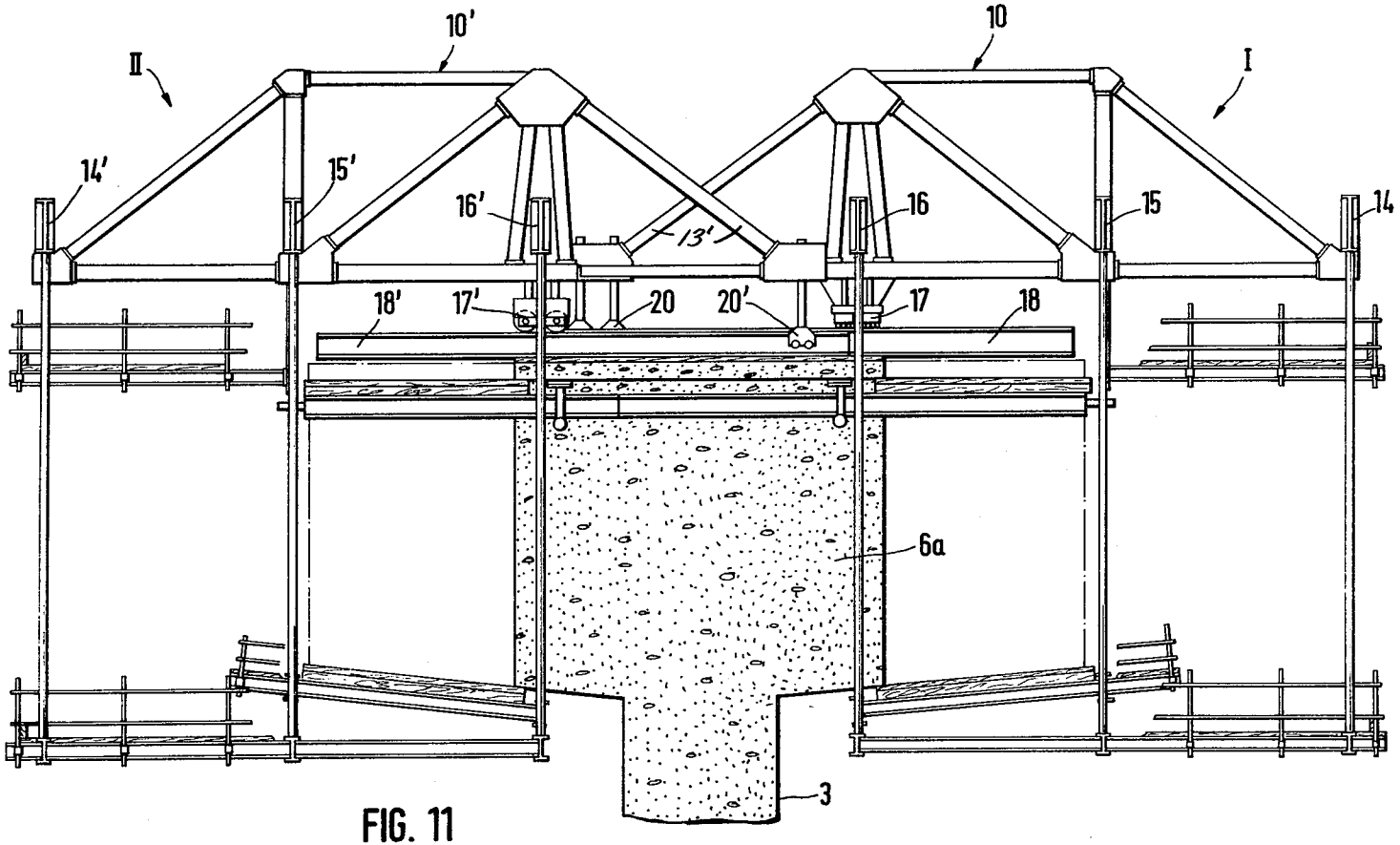
FIG. 11 is a side elevational view showing the placing of two concreting scaffolds on a pile.
Figure 12:
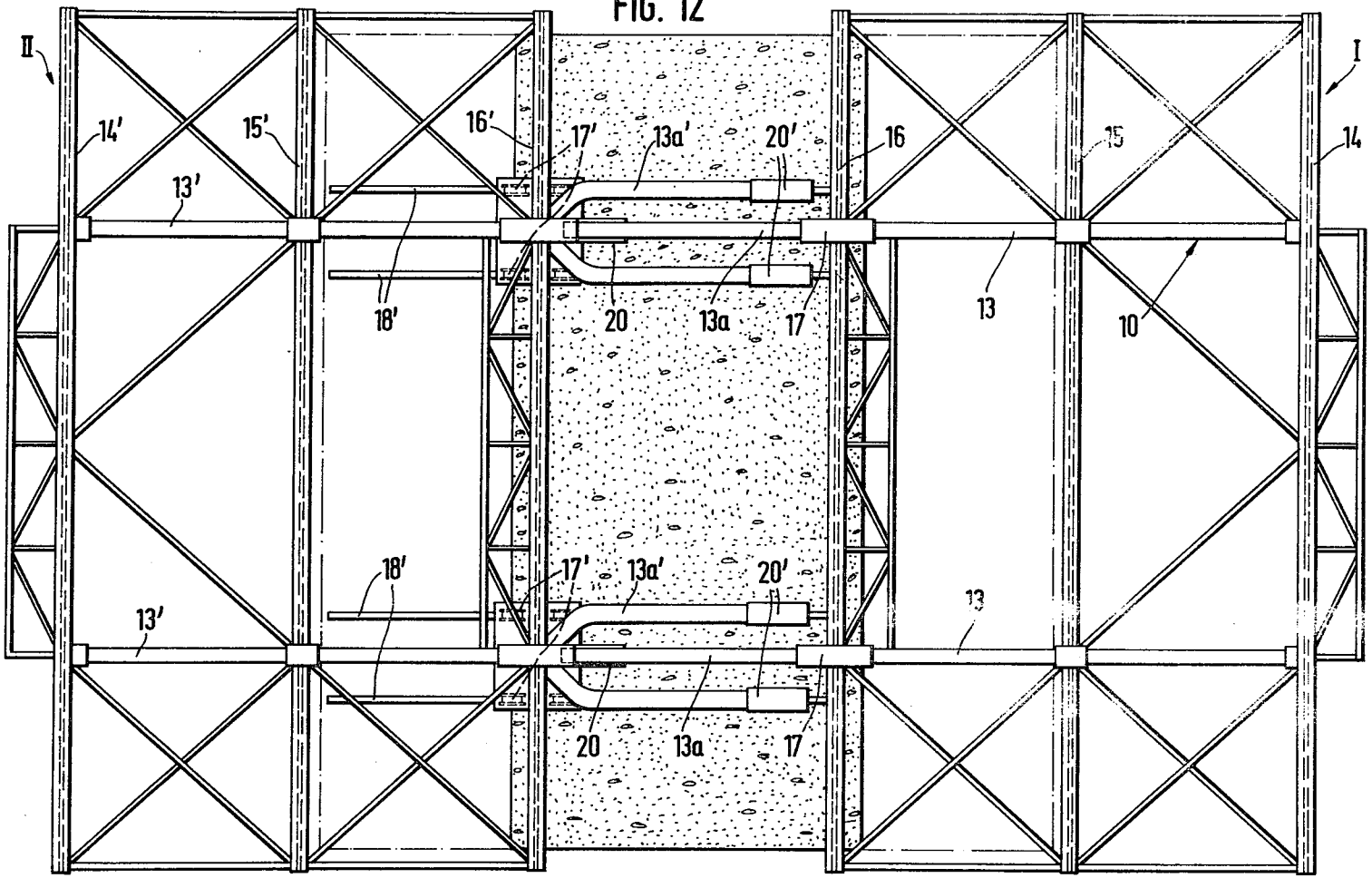
FIG. 12 is a top view showing the superstructure with the concreting scaffold in the position of FIG. 11.

The condition in which both projection cars I and II are on the superstructure part 6*a* is shown in FIG. 11. Here the rear zones 13′ of the longitudinal beams 13 of supporting part 10 of projection car II are forked, so that the corresponding part 13′ of the longitudinal girders 13 of projection car I can be introduced into the fork as can be seen in the top view of FIG. 12. This permits a closer position of the projection cars I and II with a smaller distance between them. Corresponding to the forked spreading 13″ the rollers 17 as well as the rails 18′ to projection car II are provided double.

The use of auxiliary beam 7 for fixing the superstructure section just being produced is indicated in FIG. 15 and 16. Supporting block 40 is fixed relative to auxiliary beam 7 by stays 49 and secured with regard to the superstructure section 5 by bracings 50. The cantilever is thus secured against tipping without additional expenditures.

Figure 18:
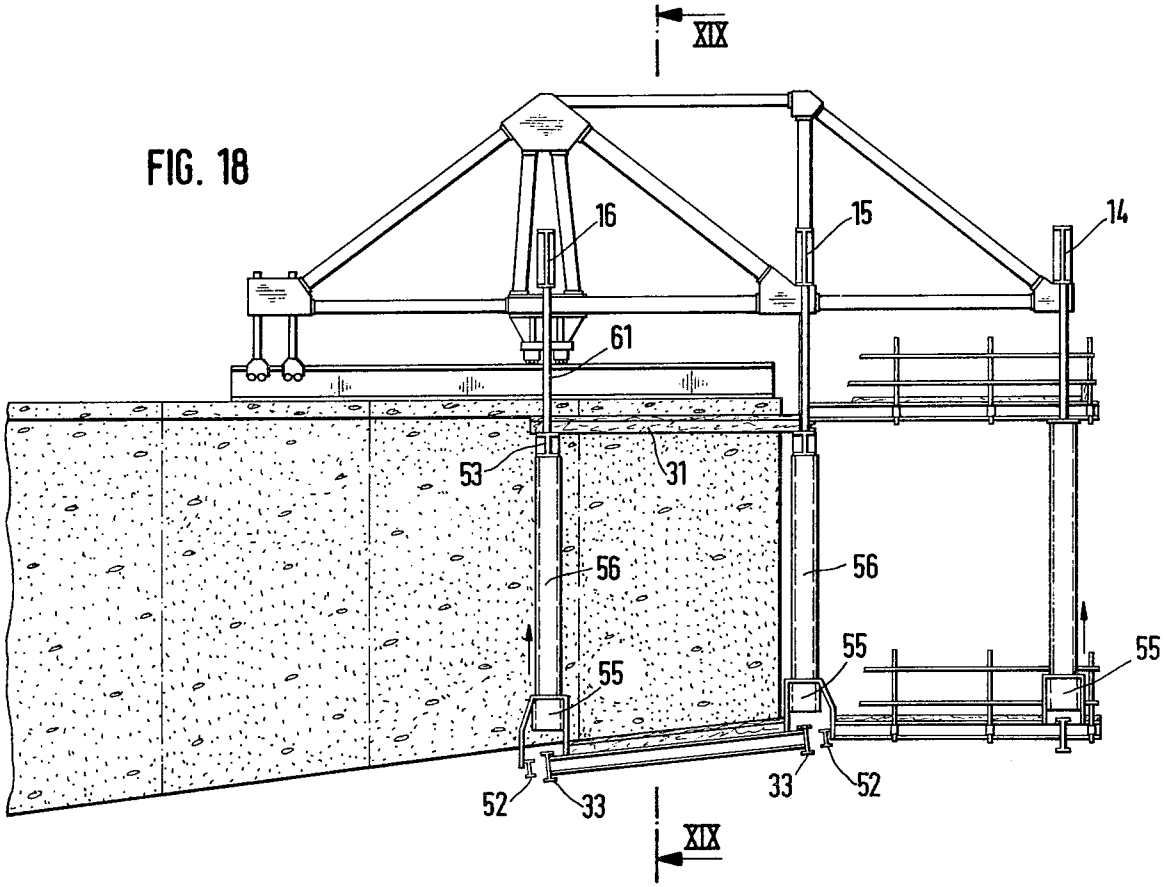
FIG. 18 is a side elevational view of another embodiment of a concreting scaffold.
Figure 19:
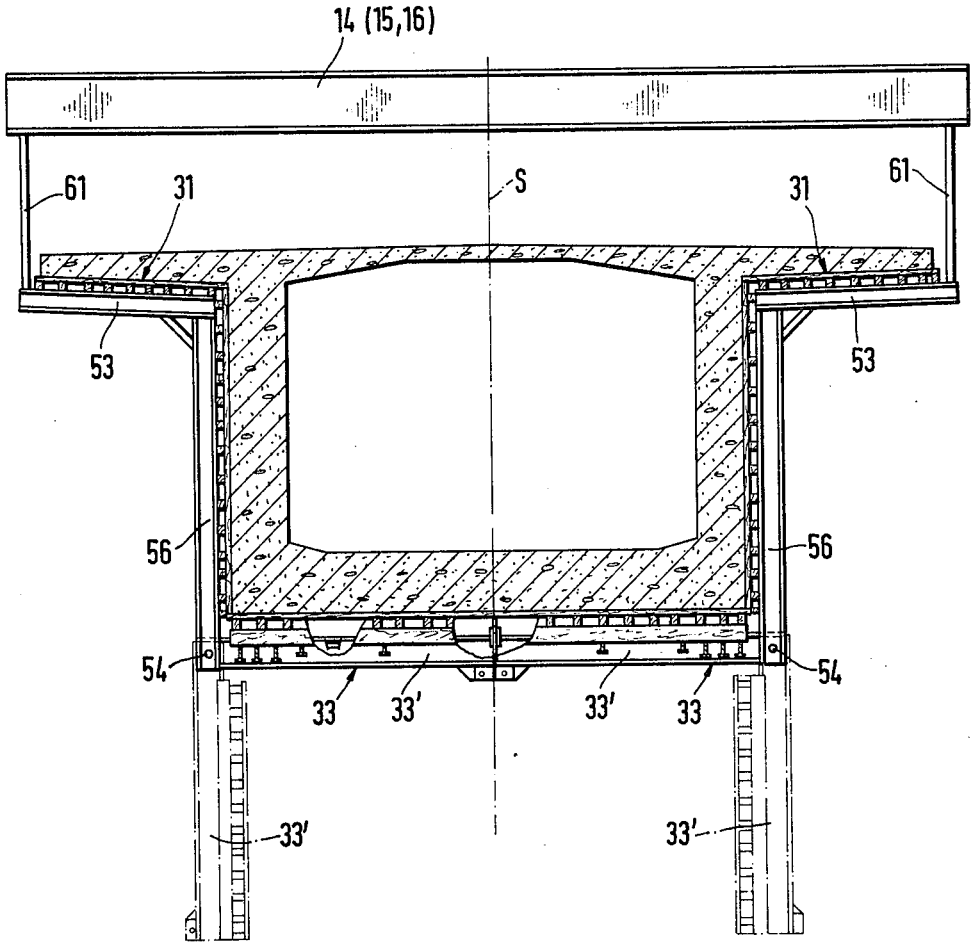
FIGS. 19 and 20 are cross sections taken along lines XIX—XIX of FIG. 18 showing two different embodiments of the concreting scaffold shown in FIGS. 18.
Figure 20:
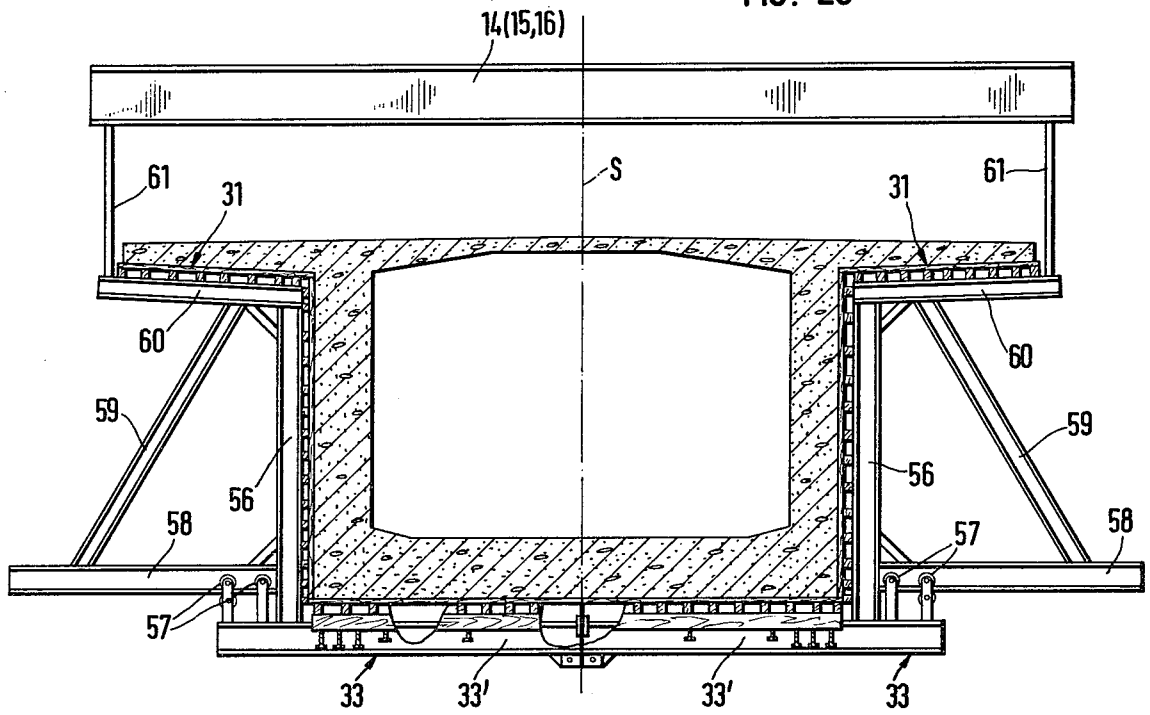

FIGS. 18 to 20 show additional embodiments of a concreting scaffold (i.e. projection car) according to the invention. Particularly with smaller bridge cross-sections, the outer casing can be self-supporting, and the platform can thus be eliminated as an additional construction element. The function of the platform as a torsion-resistant connecting element between the hangers on both sides with the possibility of exposing openings in the pile region when passing a pile is here performed by additional crossbeams 52, which are arranged next to the crossbeams 33 of the bottom casing and which can be separated, and swung out or extended in the same manner as the crossbeams 24 in FIG. 4 or the crossbeams 36 in FIGS. 13 and 14.

In the embodiment shown in FIG. 19, the parts 33' of the bottom casing, obtained by separation at the longitudinal center axis S, can be swung about hinges 54. When the hinges 54 are secured on sliding sleeves 55, the swung-out parts can be pulled up on the lateral vertical supports 56 of the casing construction. This has advantages if a pile is passed which is wider than the superstructure, and can also be used in operation to adapt the concreting scaffold to changing girder heights (FIG. 18). The construction is suspended on hangers 61 which are secured on the girders 53 of the cantilever casing 31.

In the embodiment according to FIG. 20, the parts 33' of the bottom casing crossbeams 33 are displaced on rollers 57, which run on a guide beam 58. Guide beam 58 is connected over a strut 59 with girder 60 of the cantilever casing 31 and which the hangers 61 act for the suspension of the entire construction.

While the invention has been described and illustrated with respect to certain embodiments which give satisfactory results, it will be understood by those skilled in the art, after understanding the purposes of the invention that various other changes and modifications may be made without departing from the spirit and scope of the invention, and it is therefore intended in the appended claims to cover all such changes and modifications.

What is claimed is:

1. An arrangement for projecting cantilever sections of multi-sectional bridge supporting structures of steel and concrete and/or prestressed concrete forming a superstructure which is supported on bridge piles, comprising at least one traveling auxiliary beam movably carried on and arranged above said superstructure for spanning between superstructure sections, two concreting scaffolds each comprising a supporting part having crossbeams and rollers arranged above said superstructure, said rollers riding on rails positioned above said superstructure, a platform suspended from said supporting part of said scaffolds and arranged below said superstructure for carrying casings for extending said projecting superstructure sections, a transport device movably carried on said auxiliary beam so as to support therefrom said concreting scaffolds for transporting said scaffolds between superstructure sections and from completed sections to a bridge pile for beginning construction of the next section, said supporting part of each concreting scaffold having longitudinal girders arranged adjacent said auxiliary beam, said crossbeams of said supporting part being connected to said longitudinal girders and arranged below said auxiliary beam, a pair of retractable supporting blocks supporting said auxiliary beam on a pile next succeeding a completed superstructure section, said supporting blocks being alternately retractable to allow passage of said crossbeams of said supporting part when said scaffold is transported to said next succeeding bridge pile, and said platform of said scaffolds comprising a bending resistant lattice formed by a plurality of longitudinally extending platform girders and a plurality of platform cross-beams extending transverse to said platform girders, each of said platform crossbeams having inner and outer parts, said inner parts being movable with respect to said outer parts to permit the formation of openings in said platform corresponding to the width of a bridge pile to allow said platform to pass said pile as it is transported to the next section.

2. The arrangement according to claim 1 further comprising rollers suspended on the auxiliary beam to allow said supporting blocks to move relative to said beam, and legs are provided on said supporting blocks so as to support said blocks relative to the superstructure, said legs being upwardly retractable.

3. The arrangement according to claim 1 further comprising a lattice of crossbeams and longitudinal girders suspended on hangers from said supporting part for supporting thereon a bottom casing for the section of the bridge to be completed.

4. The arrangement according to claim 3 wherein said bottom casing and said girder lattice are separable at the longitudinal center axis of the bridge.

5. The arrangement according to claim 1 wherein the outer casing for the respective bridge section to be constructed is trough-shaped and selfsupporting, said platform forming a bottom part and the bottom casing being separable in the longitudinal direction so that it may be removed from its position.

6. The arrangement according to claim 1 wherein said inner and outer parts of said platform crossbeams are provided with means for dividing said crossbeams at their longitudinal central axis.

7. The arrangement according to claim 6 wherein said inner parts are supported for movement between an opened and a closed position, said outer parts being supported in a stationary position, so that said platform openings are formed by moving said inner parts from the closed to the open position.

8. An arrangement for projecting cantilever sections of multi-sectional bridge supporting structures of steel and concrete and/or prestressed concrete forming a superstructure which is supported on bridge piles, comprising at least one traveling auxiliary beam movably carried on and arranged above said superstructure for spanning between superstructure sections, two concreting scaffolds each comprising a supporting part having crossbeams and rollers arranged above said superstructure, said rollers riding on rails positioned above said superstructure, a platform suspended from said supporting part of said scaffolds and arranged below said superstructure for carrying casings for extending said projecting superstructure sections, a transport device movably carried on said auxiliary beam so as to support therefrom said concreting scaffolds for transporting said scaffolds between superstructure sections, and from completed sections to a bridge pile for beginning construction of the next section, said supporting part of each concreting scaffold having longitudinal girders arranged adjacent said auxiliary beam, said crossbeams of said supporting part being connected to said longitudinal girders and arranged below said auxiliary beam, a pair of retractable supporting blocks supporting said auxiliary beam on a pile next succeeding a completed superstructure section, said supporting blocks being alternately retractable to allow passage of said crossbeams of said supporting part when said scaffold is transported to said next succeeding bridge pile, and said platform of said scaffolds comprising a bending resistant lattice formed by a plurality of longitudinally extending platform girders and a plurality of platform crossbeams extending transverse to said platform girders, each of said platform crossbeams having inner and outer parts, said inner parts being movable with respect to said outer parts between an opened and a closed position, said outer parts being supported in a stationary position, said inner parts of said crossbeams being mounted on hinges so that said inner parts may be swung about said hinges for movement to the open position to permit formation of opening in said platform corresponding to the width of a bridge pile to allow said platform to pass said pile as it is transported to the next section.

9. An arrangement for projecting cantilever sections of multi-sectional bridge supporting structures of steel and concrete and/or prestressed concrete forming a superstructure which is supported on bridge piles, comprising at least one traveling auxiliary beam movably carried on and arranged above said superstructure for spanning between superstructure sections, two concreting scaffolds each comprising a supporting part having crossbeams and rollers arranged above said superstructure, said rollers riding on rails positioned above said superstructure, a platform suspended from said supporting part of said scaffolds and arranged below said superstructure for carrying casings for extending said projecting superstructure sections, a transport device movably carried on said auxiliary beam so as to support therefrom said concreting scaffolds for transporting said scaffolds between superstructure sections, and from completed sections to a bridge pile for beginning construction of the next section, said supporting part of each concreting scaffold having longitudinal girders arranged adjacent said auxiliary beam, said crossbeams of said supporting part being connected to said longitudinal girders and arranged below said auxiliary beam, a pair of retractable supporting blocks supporting said auxiliary beam on a pile next succeeding a completed superstructure section, said supporting blocks being alternately retractable to allow passage of said crossbeams of said supporting part when said scaffold is transported to said next succeeding bridge pile, and said platform of said scaffolds comprising a bending resistant lattice formed by a plurality of longitudinally extending platform girders and a plurality of platform crossbeams extending transverse to said platform girders, each of said platform crossbeams having inner and outer parts, said inner parts being movable with respect to said outer parts between an opened position and a closed position, said outer parts being supported in a stationary position, said inner parts of said crossbeams being mounted for horizontally displaceable movement relative to said outer parts for movement to the open position to permit formation of an opening in said platform corresponding to the width of a bridge pile to allow said platform to pass said pile as it is transported to the next section.

10. An arrangement for projecting cantilever sections of multi-sectional bridge supporting structures of steel and concrete and/or prestressed concrete forming a superstructure which is supported on bridge piles, comprising at least one traveling auxiliary beam movably carried on and arranged above said superstructure for spanning between superstructure sections, two concreting scaffolds each comprising a supporting part having crossbeams and rollers arranged above said superstructure, said rollers riding on rails positioned above said superstructure, a platform suspended from said supporting part of said scaffolds and arranged below said superstructure for carrying casings for extending said projecting superstructure sections, a transport device movably carried on said auxiliary beam so as to support therefrom said concreting scaffolds for transporting said scaffolds between superstructure sections and from completed sections to a bridge pile for beginning construction of the next section, said supporting part of each concreting scaffold having longitudinal girders arranged adjacent said auxiliary beam, said crossbeams of said supporting part being connected to said longitudinal girders and arranged below said auxiliary beam, a pair of retractable supporting blocks supporting said auxiliary beam on a pile next succeeding a completed superstructure section, said supporting blocks being alternately retractable to allow passage of said crossbeams of said supporting part when said scaffold is transported to said next succeeding bridge pile, said platform of said scaffolds comprising a bending resistant lattice formed by a plurality of longitudinally extending platform girders and a plurality of platform crossbeams extending transverse to said platform girders, each of said platform crossbeams having inner and outer parts, said innr parts being movable with respect to said outer parts to permit the formation of openings in said platform corresponding to the width of a bridge pile to allow said platform to pass said pile as it is transported to the next section, and one of said concreting scaffolds having a forked rear portion, wherein the other of said concreting scaffolds has a rear portion arranged to be complementarily fit within said forked rear portion of the other of said concreting scaffolds.

11. The arrangement according to claim 1 wherein said auxiliary beam is rigidly connected with the superstructure cantilever and with a finished section of said superstructure during production of the cantilever in order to stabilize said auxiliary beam therebetween.

* * * * *